United States Patent [19]

Schwörer

[11] 4,329,943

[45] May 18, 1982

[54] HEATING BOILER

[75] Inventor: Emil Schwörer, Vilters, Switzerland

[73] Assignee: Eugen Josef Siegrist, Switzerland

[21] Appl. No.: 179,561

[22] Filed: Aug. 19, 1980

[30] Foreign Application Priority Data

Aug. 27, 1979 [CH] Switzerland ..... 7743/79

[51] Int. Cl.[3] ..... F22B 7/12

[52] U.S. Cl. ..... 122/17; 122/161; 122/164; 122/33; 122/182 S

[58] Field of Search ..... 122/135 F, 155 R, 155 C, 122/155 F, 158, 161, 164, 13 R, 16–18, 33, 182 R, 182 S

[56] References Cited

U.S. PATENT DOCUMENTS

| | | | |
|---|---|---|---|
| 503,834 | 8/1893 | Doll et al. | 122/164 |
| 1,885,040 | 10/1932 | Arnold | 122/17 |
| 2,089,734 | 8/1937 | Czeschin | 122/18 |
| 2,552,044 | 5/1951 | Huet | 122/161 |
| 2,832,320 | 4/1958 | Thome et al. | 122/161 |
| 4,257,355 | 3/1981 | Cook | 122/17 |

FOREIGN PATENT DOCUMENTS

| | | | |
|---|---|---|---|
| 1067670 | 6/1954 | France | 122/17 |
| 365769 | 1/1932 | United Kingdom | 122/17 |
| 897424 | 5/1962 | United Kingdom | 122/13 R |

*Primary Examiner*—Henry C. Yuen

*Attorney, Agent, or Firm*—McGlew and Tuttle

[57] ABSTRACT

A heating boiler comprises an outer housing with a cylindrical wall in the housing extending from one end thereof and defining therewithin a primary fire chamber. A cylindrical fire space wall portion is radially spaced outwardly of the cylindrical fire wall and extends along the length of the fire wall and has a secondary portion which extends axially beyond the length of the cylindrical wall and has a greater diameter than the cylindrical wall and defines therein a secondary fire chamber which communicates with the primary fire chamber. The housing also contains a wall spaced radially inwardly of its interior which defines a chamber water space between the wall and the fire space wall and also a hot water tank between the wall and the interior of the housing. A plurality of smoke tubes are arranged at spaced locations around the fire space wall and they extend through the chamber water space and permit passage of gases from the end of the secondary fire space remote from the primary space through the chamber water space and to a waste gas pipe leading out of the boiler. Tubular thin wall lining is located between the cylindrical wall defining the primary fire chamber and the fire space wall portion spaced radially outwardly thereof leaving a clearance between the cylindrical wall defining the primary fire chamber and the fire space wall which is bridged by the lining under certain operating temperature conditions.

9 Claims, 1 Drawing Figure

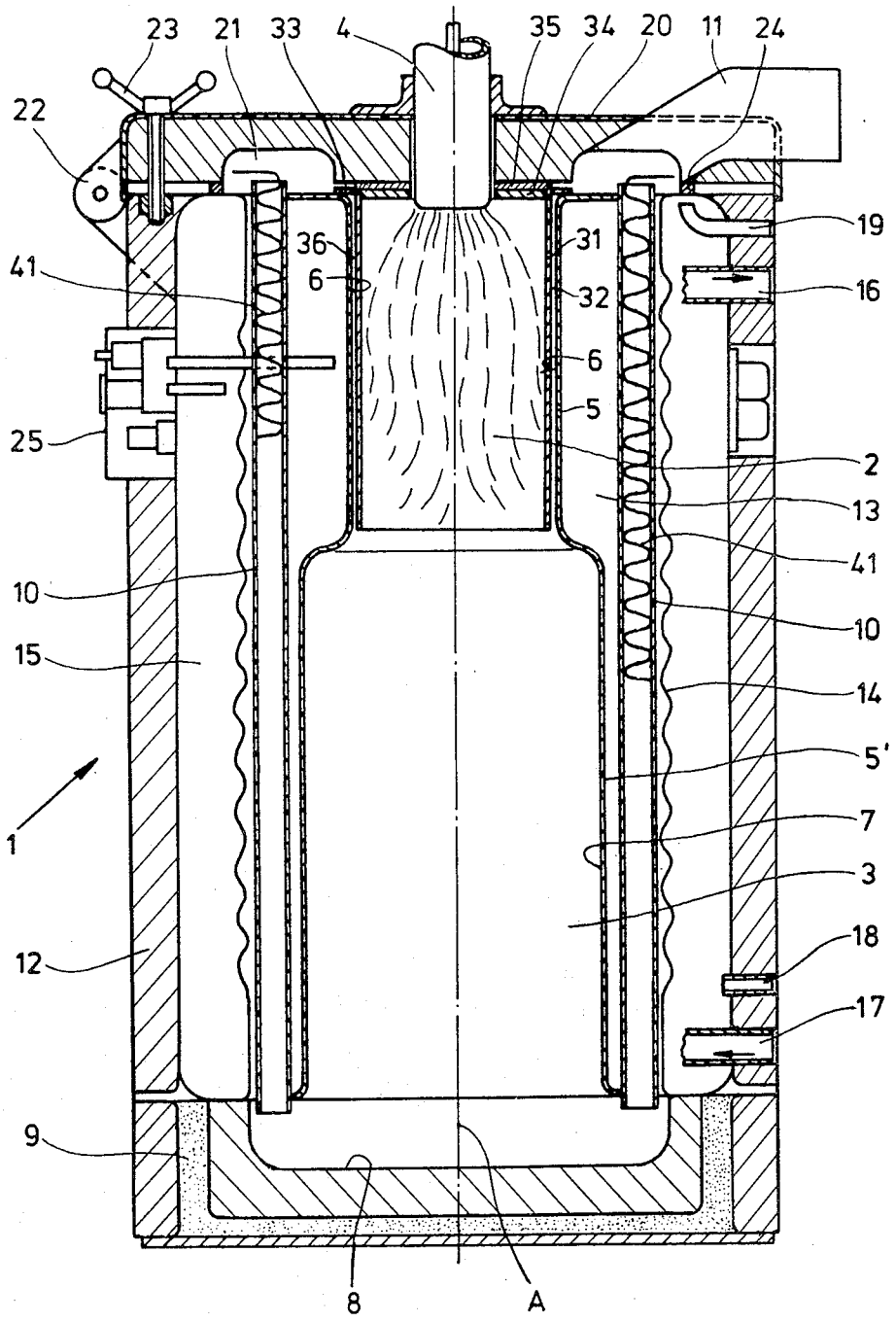
23
21
33
4
35
34
20
11
24
22
19
36
31
41
6
32
16
6
5
25
2
13
41
10
10
15
14
5'
1
7
3
12
18
17
9
8
A

HEATING BOILER

FIELD AND BACKGROUND OF THE INVENTION

This invention relates in general to the construction of heating boilers and in particular to a new and useful heating boiler having axially arranged communicating primary and secondary fire chambers with a fire space wall spaced outwardly from the primary fire chamber having a lining therebetween maintaining a gap between these walls.

Heating boilers of the general type of the present invention are known from German OS. No. 27 21 832 and have proven extraordinarily satisfactory in practice. However, since the wall of the primary fire space is continually cooled from the outside by the cooling water, whereby the marginal flame zone also is considerably cooled, a certain amount of soot is inevitably formed. This may entrail soot deposits in the smoke tubes, which may affect the firing performance of the heating boiler so that in the long run, the waste gas temperatures will increase and such heating boilers will no longer be operable with an optimum efficiency.

The invention is directed to a heating boiler in which the mentioned drawbacks are avoided. Primarily, even after long periods of service, no soot is formed, so as to keep the waste gas temperature constant and substantially improve the long term performance of the heating boiler and to always ensure an optimum efficiency.

In accordance with the invention there is provided a heating boiler which includes an outer housing with a cylindrical wall in the housing extending from one end thereof and defining therewithin a primary fire chamber. A cylindrical fire space wall has a portion which surrounds the cylindrical primary fire chamber wall and is spaced radially outward thereof and has a secondary portion of a greater diameter than the first portion which extends axially beyond the primary fire chamber and defines a secondary fire chamber. The gases which are delivered to the extreme end of the secondary fire chamber pass through one or more conduits which extend through a water space defined between the fire space wall and a corrugated tubular partition wall spaced inwardly of the interior of the housing. The space between the partition wall and the interior of the housing defines a hot water tank. The lining is disposed between the cylindrical wall defining the primary fire chamber and the portion of the fire space wall which is spaced radially outwardly thereof to maintain a clearance gap between these walls which is bridged by the lining itself when the operating temperatures in the furnace are such as to effect this bridging. The cylindrical wall of the fire space is advantageously dimensioned so that as soon as the temperature of the lining attains about 1000° C. the lining applies due to its expansion to the water cooled fire space wall.

On the side adjacent the burner lining is advantageously provided with an outwardly projecting flange which is supported on the fire space wall. The bottom of the lining is advantageously provided with an insulation. The lining is advantageously made of a temperature resistant chromium nickel steel or ceramic material. Conduits which are provided for the conduction of the gases from the secondary combustion space may include turbulators therein which are advantageously of a variable length.

In, accordance ith the invention, a lining closely spaced from the wall of the primary fire space of a heating boiler is inserted, not only optimum combustion values are obtained instantly upon setting the boiler in operation, but also the firing conditions are kept constant for a very long period of time. The lining, initially forming a gap with the surrounding wall of the fire space, is thus heated up within a short period of time to the operating temperature, since it is not cooled optimum combustion conditions are created instantly, without permitting a formation of soot or oil derivatives. Further, since the gap-like clearance is so dimensioned that at a definite temperature of the lining, the lining applies to the water cooled wall of the fire space, it also is ensured that no overheating and no burning through occurs. The lining wall rather expand up to a contact with the wall and then contract again, i.e. it will cyclically expand and contract to give heat off and take it up.

In this way, soot formation which would otherwise be favored by too low temperatures of the fire space wall, is prevented and soot deposits in the heating boiler are avoided. Further, the fire space wall cannot burn through and, primarily, no overheating occurs which might create conditions for the formation of toxic nitrogen oxide gases. A heating boiler designed in this way can always operate with a high efficiency of about 90% and the waste gas temperature remains at a constant low level of about 120° C., so that the waste gas losses are small and excellent combustion results are obtained at all times. Turbulators which may be inserted in the smoke gas tubes remain clean and the gas resistance remains constant. The turbulators produce the effect that more thermal energy is transferred and the performance of the boiler is augmented without the necessity of increasing the waste gas temperature and without clogging the smoke tubes with soot.

Accordingly it is an object of the invention to provide an improved heating boiler which includes primary and secondary fire chambers arranged in axial alignment with the primary fire chamber being formed by an inner wall which is spaced radially inwardly from an outer wall with a lining disposed therebetween containing a gap between these walls and forming a bridge therebetween when the operating temperatures heating the lining to a temperature sufficient to expand it into contact with both walls.

A further object of the invention is to provide a heating boiler which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only FIGURE of the drawing is an axial sectional view of a vertical heating boiler constructed in accordance with the invention.

GENERAL DESCRIPTION OF PREFERRED EMBODIMENT

A heating boiler comprises an outer housing, a cylindrical wall in the housing extending from one end thereof and defining therewithin a primary fire chamber, a cylindrical fire space wall radially spaced outwardly of the cylindrical fire chamber wall and extending along the length of the fire chamber wall and having a secondary portion extending axially beyond and being of a greater diameter than said fire chamber wall and defining a secondary fire chamber therewithin connected to the primary fire chamber, wall means in the housing spaced radially inwardly of the interior of said housing by defining a chamber water space between said wall means and said cylindrical fire space wall portion and said secondary wall portion and defining a hot water tank between said wall means and the interior of said housing, gas discharge means including at leat one conduit extending through said chamber water space to the exterior of said housing and communicating with the end of said secondary fire chamber which is remote from said primary fire chamber, and a tubular thin wall lining between said fire chamber wall and said fire space wall and leaving a clearance between said walls which upon a predetermined boiler operating temperature is bridged by said lining.

The heating boiler is advantageously dimensioned so that as soon as the temperature of the lining attained about 1000° C. the lining applied due to its expansion to the water cooled fire space wall. The lining is provided with an outwardly projecting flange by which it is supported in the fire space wall and on the side proximate to the burner of the boiler the lining is provided with an inserted bottom. The bottom of the lining is provided with an insulation. The lining itself is advantageously made of a temperature resistant chromium nickel steel or a ceramic material. The device may also include a gas discharge means in the form of conduits which include turbulators preferably having a variable length inserted in the conduits.

Referring to the drawings in particular the invention embodied therein comprises a heating boiler which comprises an outer housing 1 with a cylindrical fire chamber wall 6 in the housing extending from one end thereof and defining therewithin a primary fire chamber 2. A cylindrical fire space wall portion 5 is radially spaced outwardly of the cylindrical fire chamber wall and extends along the length of the fire chamber wall in an axial direction and has a secondary portion extending axially beyond the length of the fire chamber wall which is of greater diameter than the fire chamber wall. The secondary portion defines a secondary fire chamber 3 which communicates to the primary fire chamber 2. The construction includes wall means in the form of a corrugated wall 14 spaced radially inwardly from the interior of the housing and defining a chamber water spaced 13 between the wall 14 and the fire spaced wall and the secondary fire space wall portion and also defining a hot water tank 15 between the corrugated wall 14 and the interior of the housing. The construction includes gas discharge means including at least one conduit or smoke tube 10 which extends through the chamber water space 13 and connects to an annular smoke gas collecting duct which connects to a waste gas pipe 11 leading out of the boiler.

In accordance with the invention a tubular thin walled lining 31 is disposed between the fire chamber wall 6 and the cylindrical fire space wall portion 5 leaving a clearance between these two walls which upon a predetermined boiler operating temperature is bridged by the lining. This is caused by expansion of the lining during heating and is advantageously dimensioned so that the temperature of the lining attains about 1000° C. it will expand into contact with the water cooled fire space wall 5.

The vertical heating boiler shown in the drawing and generally designated 1, comprises a fire space which extends along the central axis A and is formed by a primary fire chamber 2 having a cylindrical primary heating surface 6, and an adjacent secondary fire chamber 3 having a secondary heating surface 7 which is larger in diameter than the primary heating chamber. A burner for gaseous or liquid fuel protrodes into primary fire chamber 2. The secondary fire chamber 3 is closed by a bottom 8 which is provided with an insulation 9. The area of heating surfaces 6 and 7 as well as the diameters of the fire chambers 2 and 3 which are bounded by primary and secondary sheet metal wall portions 5 and 5' are determined in accordance with German OS No. 2 721 832.

A plurality of circumferentially spaced smoke tubes 10 extending from the bottom part of fire chamber 3 are arranged in a circular configuration and form booster heating surfaces having a larger area than primary and secondary heating surfaces 6 and 7. Smoke tubes 10 open at the burner side of heating boiler 1 into an annular smoke gas collecting duct 21 which is provided in a hinged top wall 20 of boiler 1 and to which a waste gas pipe 11 is connected. A corrugated tube partition 14 extends around the exterior and is supported by the smoke tubes 10. Between the sheet wall portions 5 and 5' and partition 14 there is a water space 13 of the boiler and along with an outer wall 12 of the boiler, the construction forms a hot water tank 15.

The water leaves space 13 laterally through a discharge pipe 16 which extends through a space 15 between walls 72 and 74 and 14 and circulates through the heating system (not shown). The water returns to space 13 through an inlet pile 17. In a similar way, pipes 18 and 19 are connected to hot water tank 15, with the cold water entering through an inlet pipe 18 and the heated water flowing out through a discharge pipe 19 to the point of utilization. An instrument board 25 is inserted in the outer bottom wall 12 which is designed as an insulation. The instruments serve the purpose of monitoring the temperatures in water space 13 and tank 15.

Top wall 20 is jointed to outer boiler wall 12 by means of hinges 22, preferably two diametrically oppositely located ones, so that the top wall may be pivoted outwardly to either side for cleaning or inspection. Top wall 20 is pressed against the upper rim of wall 12 by lever-operated screws 23, with gaskets 24 being provided at the inside of the wall for reliably sealing the boiler.

To insure a quick temperature rise in the primary fire chamber 2 to the operating temperature and thus to prevent soot formation, the primary fire chamber 2 is provided with a lining 31 of a heat resistant, thin walled material, for example chromium-nickel steel. A gap-like clearance 32 is provided between fire space wall 5 and lining 31 which is so dimensioned than lining 31 applies to the wall portion 5, which is cooled from the outside, only after the temperature of the lining has risen to about 1000° C.

Lining 31 is supported on fire space wall 5 by means of a circumferential flange 33 provided on the lining. Further, a bottom sheet 34 as well as an insulation 35 are inserted between the top wall and lining 31.

Upon setting burner 4 in operation, the thin walled lining 31 is very rapidly heated up. Therefore, after a short period of time, the flame tips of the burner flame no longer strike a cooled surface and a soot formation is securely prevented. As soon as lining 31 reaches a temperature of about 1000° C., it is expanded to such an extent that its outer surface 36 applies against primary heating surface 6 which is continuously cooled by water from the outside. Lining 31 is thereby cooled down, so that it contracts again and this expansion and contraction will cyclically continue, with lining 31 alternately absorbing and transferring heat. In this way, overheating and formation of nitrogen oxide gases are also prevented.

Further, since soot formation and thus fouling of the heating boiler 1, particularly of smoke tubes 10, is effectively eliminated by the provision of lining 31 of primary fire chamber 2, turbulators 41, for example, bent of wire, may be inserted into smoke tubes 10 in order to increase the efficiency of the boiler. Boiler 1 may then be operated for a long period of time even with higher performances at a waste gas temperature of about 120° C., thus with small thermal losses, so that in the long run the efficiency of the boiler is considerably improved.

While a specific embodiment of the invention has been shown and described in detail to illustrate the application of the principles of the invention, it will be understood that the invention may be embodied otherwise without departing from such principles.

The embodiments of the invention in which an exclusive property or privilege is claimed are defined as follows:

1. A heating boiler comprising an outer housing, a cylindrical fire chamber wall in said housing extending axially from one end thereof and defining therewithin a primary fire chamber, a fuel burner extending into said chamber from said one end of said housing, a cylindrical fire spaced wall portion radially spaced outwardly of said fire chamber wall and extending along the length of said fire chamber wall and having a secondary cylindrical fire space wall portion extending axially beyond the length of said cylindrical fire chamber wall and being of a greater diameter than said fire chamber wall and defining in said secondary portion a secondary fire chamber connected to said primary fire chamber, wall means in said housing spaced radially inwardly of the interior of said housing and defining a chamber water space between said wall means and said fire space wall portion and said secondary fire space wall portion and defining a hot water tank between said wall means and the interior of said housing, gas discharge means including at least one conduit extending through said chamber water space to the exterior of said housing and communicating with the end of said secondary fire chamber which is remote from said primary fire chamber, and a tubular thin walled lining between said fire chamber wall and said fire space wall portion leaving a clearance therebetween which upon a predetermined operating boiler temperature is bridged by said lining.

2. A heating boiler according to claim 1, wherein said clearance between said lining and said fire space wall is so dimensioned that as soon at the temperature aligning attains about 1000° C. the lining applies due to its expansion to said fire space wall which is cooled by the water in said chamber water space.

3. The heating boiler according to claim 1, wherein said lining includes a side adjacent said burner provided with an outwardly projecting flange, said flange being supported on said fire space wall portion.

4. A heating boiler according to claim 1, wherein said lining is provided with a bottom adjacent said one wall of said housing.

5. A heating boiler according to claim 4, wherein said bottom of said lining is provided with an insulation.

6. A heating boiler according to claim 5, wherein said lining is made of a temperature resistant chromium-nickel steel.

7. A lining according to claim 4, wherein said lining is made of a ceramic material.

8. A heating boiler according to claim 1, wherein said at least one conduit comprises a smoke tube including a turbulator disposed in said smoke tube.

9. A heating boiler according to claim 1, wherein said at least one conduit defining said gas discharge means includes a plurality of circumferentially spaced smoke tubes extending through said chamber water space, said housing having a bottom spaced from the end of said fire space secondary wall portion through which gas exiting therefrom is delivered and deflected into said smoke tubes.

* * * * *